US006342873B1

(12) United States Patent
Ueoka et al.

(10) Patent No.: US 6,342,873 B1
(45) **Date of Patent: *Jan. 29, 2002**

(54) SURFACE DISCHARGE TYPE PLASMA DISPLAY DEVICE SUPPRESSING THE OCCURRENCE OF ELECTROMAGNETIC FIELD RADIATION

(75) Inventors: Mitsuo Ueoka; Keiji Nunomura, both of Tokyo (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/997,549

(22) Filed: Dec. 23, 1997

(30) Foreign Application Priority Data

Dec. 25, 1996 (JP) ..... 8-345471

(51) Int. Cl.[7] ..... G09G 3/28

(52) U.S. Cl. ..... 345/60; 345/62; 345/66; 345/67

(58) Field of Search ..... 345/60–72; 315/169.1, 315/169.4

(56) References Cited

U.S. PATENT DOCUMENTS 4,296,357 A * 10/1981 Hirayama et al. ..... 345/60
4,728,864 A * 3/1988 Dick ..... 345/60
5,081,400 A * 1/1992 Weber et al. ..... 315/169.4
5,420,601 A * 5/1995 Amano ..... 345/60
5,420,602 A * 5/1995 Kanazawa ..... 345/67
5,483,252 A * 1/1996 Shigeta ..... 345/67
5,907,311 A * 5/1999 Yano ..... 345/4
6,091,380 A * 7/2000 Hashimoto et al. ..... 345/60

FOREIGN PATENT DOCUMENTS

JP 59-63956 4/1984
JP 4-332430 11/1992
JP 7-248744 9/1995

OTHER PUBLICATIONS

"Driving Method of 40–inch type full–color ACPDP" *Monthly Display* pp. 46–50 (1996).

* cited by examiner

*Primary Examiner*—Almis R. Jankus
*Assistant Examiner*—Amr Awad
(74) *Attorney, Agent, or Firm*—Foley & Lardner

(57) ABSTRACT

In a surface discharge type plasma display device, lead-out wirings for a plurality of surface discharge electrode pairs of a scanning electrode 3 and sustaining electrodes 4 are arranged such that current flowing directions of adjacent pairs of the surface discharge electrodes during a sustaining discharge period are opposite to each other.

9 Claims, 7 Drawing Sheets

SURFACE DISCHARGE TYPE PLASMA DISPLAY DEVICE SUPPRESSING THE OCCURRENCE OF ELECTROMAGNETIC FIELD RADIATION

BACKGROUND OF THE INVENTION

1. Field of the Invention

The present invention relates to plasma display devices, and more particularly to a surface discharge type plasma display device having an electrode configuration and a circuitry configuration which are capable of suppressing the occurrence of radiation of electromagnetic field by a plurality of high voltage pulses which form driving waveforms.

2. Prior Art

Plasma display device is one of flat display devices and an emissive type display device. And it has been expected as a display device which may realize a large-scale wall mounting TV because this plasma display may be easily manufactured using thick film technology at relatively low costs. In regard to this plasma display, discharge cells corresponding to display pixels are arranged in a matrix form to selectively discharge a discharge cell for exciting a phosphor with luminous ultraviolet rays, thereby providing three primary colors of red, green and blue. There are a DC type plasma display in which electrodes are exposed in a discharge space and an AC type plasma display in which electrodes are isolated from the discharge space. It is generally known that the AC type plasma display has a longer life time because of the isolation of electrodes from discharge space as stated above. In the AC type plasma display, there are an opposed-electrode type plasma display configured by facing electrodes to each other, and a surface discharge type plasma display having surface discharge electrodes which are configured by arranging electrodes in parallel on one substrate as disclosed in Japanese Unexamined Patent Publication No. 4-332430. Among them, the surface discharge type plasma display is generally considered to be the most suitable for large scale color display because it has a wide memory margin, high brightness and emissive efficiency.

FIG. 4 shows a block diagram of a system configuration of a conventional surface discharge type plasma display device. This display device is similar to the surface discharge type plasma display shown in the article titled "Driving method of 40-inch type full-color ACPDP" in the Japanese monthly magazine "Monthly Display" (pp. 46–50, April, 1996).

According to a block diagram of a drive unit, this conventional surface discharge type plasma display comprises a plasma display panel 15, a data driver 16, a sustaining driver 17, a scanning driver 18, a scanning pulse generator circuit 19 and a mixer 20.

Display data and control signal from outside of the device are appropriately converted by an interface circuit, and supplied to a data driver 16, a sustaining driver 17 and a scanning driver 18 (the interface circuit is not shown in the block diagram).

FIG. 5 shows a schematic cross sectional view as an example of one pixel of a surface discharge type plasma display panel used in the above device. The panel comprises an insulative substrates 1, 2, a transparent scanning electrode 3, a transparent sustaining electrode 4, trace electrodes 5, 6, a data electrode 7, a dielectric layers 12, 14, a protective layer 13, a phosphor 11 and a plurality of ribs 9. A numeral 8 designates a discharge gas space. In the figure, though the ribs 9 are not depicted in detail, the striped ribs are formed to be transverse with the scanning electrode 3 and sustaining electrode 4 to separate pixels and keep the space between insulative substrates 1 and 2. Furthermore, metal electrodes (trace electrodes 6, 7) are laminated on both of the scanning electrode 3 and the sustaining electrode 4 to decrease the resistance thereof.

FIG. 6 shows schematic views of driving pulse trains of said surface discharge type plasma display panel. On the scanning electrodes 3 corresponding to the rows of matrix displays, pulse trains SC1, SC2, SC3, SCn ("n" is an integer in response to the number of lines) are applied in the order from the above. Pre-discharge pulses or priming pulses, scanning pulses, sustaining pulses B of the pulse train (SCn) to be applied to the scanning electrode 3 are generated by a high voltage pulse generator 19 for the scanning electrodes 3, and its timings are controlled by the signal of interface with a scanning driver 18. The sustaining electrodes 4 paired with scanning electrodes 3 are connected in common and a sustaining pulse trains SUS are applied thereto. The priming pulse and the sustaining pulse A of the pulse train (SUS) to be applied to the sustaining electrodes 4 are generated by a high voltage pulse generator 17 for the sustaining electrodes 4. Since the priming pulses and the sustaining discharge pulses A, B are applied at the same time to all scanning electrodes 3 and to all sustaining electrodes 4, it is required that withstand voltage is high, voltage is large and ON-resistance is low. Thus, a circuit is configured with discrete parts such as FETs and resistors. On the other hand, scanning pulses (Vw) are applied to the scanning electrodes 3 respectively at different timings, and accordingly, the number of circuits should be the same as that of the scanning electrodes 3. Therefore, IC with high withstand voltage is used to superimpose scanning pulses by using diode circuit in a mixer 20 and apply them to the scanning electrodes 3. Furthermore, IC with high withstand voltage is used because data electrodes 7 need to be applied data pulses independently according to the display data.

The reason for using ICs with high withstand voltage is that since the scanning electrodes 3 and the data electrodes 7 are driven independently, a lot of circuits are required, and since output electric current is relatively small, integration is enabled and the drive circuit may be cost down.

The driving pulse trains SUS, SCn and DATA are divided respectively into a pre-discharge (priming) period Tp, write-in discharge (addressing) period Tw and sustaining discharge period Ts, respectively. The priming period Tp applies priming pulses between the scanning electrodes 3 and the sustaining electrodes 4 to generate discharge and to crease charged particles and excitation particles such as ions and electrons as well as to control wall charges on the scanning electrodes 3, sustaining electrodes 4 and data electrodes 7 with fixed amounts, thereby serving to stabilize the discharge of the addressing period Tw.

During the priming period Tp, all scanning electrodes 3 are applied with the scanning pulses successively, and write-in discharges are generated, in relation with the data electrodes 7, by means of data pulse to be applied in accordance with the display data, thereby serving to address the display data as the wall charges.

During the sustaining discharge period Ts, the sustaining pulses A shown in FIG. 6 are applied to the scanning electrodes 3 while the sustaining pulses B shown in FIG. 6 are applied to the sustaining electrodes 4, thereby sustaining the display discharge. Thus, the write-in discharge is created only in the pixel issuing luminescence according to the display data between the scanning electrodes 3 and the data electrodes 7 so as to form the wall charges on the protective layer 13 on the side of the scanning electrodes 3. Based on this information, the discharge is sustained between the scanning electrodes 3 and the sustaining electrodes 4 to obtain desired luminescence. The display is performed by exciting selectively the red, green and blue phosphors 11 by ultraviolet rays created by the sustaining discharge.

Since surface discharge type plasma display panel uses the ultraviolet rays generated by discharging as mentioned above, it requires high voltage pulse trains of such frequency of several hundred kHz having a value of wave height of around several hundred voltages, and further it requires relatively high power. In the sustaining discharge period, therefore, the sustaining pulses B are applied to the scanning electrodes 3 as shown in FIG. 6, while the sustaining pulses A is applied to the sustaining electrodes 4. Since the sustaining pulses A and B are applied to all scaning electrodes 3 and to all sustaining electrodes 4, currents for charging and discharging the capacity between both electrodes become large impulse currents, and flow in the drive circuits, the scanning electrodes and the sustaining electrodes at the same time and in the same directions. This impulse current becomes not less than 10 times of impulse current generated at times of the write-in discharging or other discharging, and is a main cause of unnecessary radiation of the electromagnetic field in the surface discharge type plasma display.

For example, when displaying a whole surface of a large sized panel of 33-inches or 42-inches types with high brightness, the impulse current of several amperes at maximum flows, whereby there occurs disadvantage that a fairly strong unnecessary radiation of the electro-magnetic field is caused from the scanning electrodes, sustaining electrodes, high voltage drive circuits and others.

FIG. 7 schematically shows, taking out from the block diagram of the system configuration of FIG. 4, the connections between the high voltage pulse generator 19 for the scanning electrodes and the high voltage pulse generator 17 for the sustaining electrodes during the sustaining discharge period as-well as the scanning electrodes 3 and the sustaining electrodes 4 and directions of main impulse currents.

When displaying, the sustaining pulses B are applied to all scanning electrodes 3 from the high voltage pulse generator 19 and the sustaining pulses A are applied to all sustaining electrodes 4 from the high voltage pulse generator 17.

These sustaining pulses A and B have rectangular waves of about 200 V having frequencies of several hundred kHz of reversing the phases each other. Accordingly, the impulse current flows along a current path I1 at rising and falling of the sustaining pulses A and B from the high voltage pulse generator 19 through the scanning electrodes 3 and sustaining electrodes 4 to the high voltage pulse generator 17 (the current path is designated with "I1" of FIG. 7), and at subsequent falling and rising, an impulse current of opposite directions flows. Thus, this is repeated alternately.

Therefore, for displaying the whole of the faceplate, all discharge spaces should be discharge so that the impulse current flows in all scanning electrodes 3 and sustaining electrodes 4, and current value increases, and correspondingly unnecessary radiation of electromagnetic field increases. Further, since this impulse current is large, it invades as voltage or current noises into the drive circuits, and disturbs image signals and hinders pictures.

A method of avoiding unnecessary radiation of electromagnetic field and invasion of noises into pictures is disclosed in Japanese Unexamined Patent Publication No. 7-248744, in which the sustaining pulse is phase-modulated by a pseudo-random noise generating circuit and applied. This driving method disperses the impulse current generated by discharging when displaying, thereby decreasing the peak value of the current so as to check occurrence of unnecessary radiation of electromagnetic field and noises.

On the other hand, for a method of suppressing unnecessary radiation of the electromagnetic field, as disclosed in Japanese Unexamined Utility Model Publication No. 59-63956, such a configuration is proposed that a transparent shielding film filter is arranged on the surface of plasma display panel. Although this shielding technique suppresses unnecessary radiation of electromagnetic field, the shielding effect of the electromagnetic field is not sufficient. A more effective alternative is to use a good conductor or a mesh filter plated with the good conductor.

According to the method of dispersing the discharged impulse current, since the discharging timing should be phase-modulated at random, disadvantageously the driving circuit is complicated, and the driving margin is narrowed.

On the other hand, the method of arranging the shielding film of the electromagnetic field is to suppress unnecessary radiation of electromagnetic field by enclosing it, perfect shielding effect of the unnecessary radiation of electromagnetic field could hardly provided in itself. For increasing the realizing effect, as an implementation effect, the good conductor is used or a resin plated with the good conductor is used for a frame and they are should be grounded.

The stronger the unnecessary radiation of the electromagnetic field from the plasma display is, the higher the costs for preventing radiation of the electro-magnetic field become. Further, the larger the display planed is, the higher the costs for suppressing radiation of the electromagnetic field become, since said pmpulse current increases.

SUMMARY OF THE INVENTION

It is an object of the present invention to provide an arrangement of electrodes and a wiring configuration of drive circuits which may decrease unnecessary radiation of electromagnetic field with respect to a surface discharge type plasma display, without resorting to additional electromagnetic shielding filter or a frame, and thus plasma display may be realized at low costs.

According to the present invention, adjacent surface discharge electrodes are driven so as to have opposite discharge directions to each other. Preferably, the discharge directions are determined so as to suppress the radiation of unnecessary electromagnetic field.

Furthermore, all of the surface discharge electrodes are divided into a plurality of blocks, and which are arranged such that its discharge currents are turned in opposite one another with respect to adjacent blocks.

Furthermore, the current flowing directions of wiring of the drive circuits of the surface discharge electrodes and circuit group are configured to be in opposite direction with respect to at least one wiring and circuit of the drive circuits of the at least surface discharge electrodes.

Preferably, the current flowing direction of the wiring group of the surface discharge electrodes and the circuit group are arranged to be opposite alternately.

The wiring group and circuit group of the drive circuits of the surface discharge electrodes are divided into at least one drive circuit block, and the drive circuits of the surface discharge electrodes are configured such that the currents of the drive circuit group are in opposite directions with respect to at least one drive circuit block.

More preferably, the color plasma display has the same number of the wiring group and the circuit group of the drive circuits of the surface discharge electrodes of the currents facing in opposite directions, and comprises the drive circuits of the surface discharge electrodes of the same number as the drive circuit blocks of the surface discharge electrodes, and has the same number as the drive circuit block of the surface discharge electrodes of the current facing in opposite directions.

DESCRIPTION OF THE PREFERRED EMBODIMENTS

Figure 1:
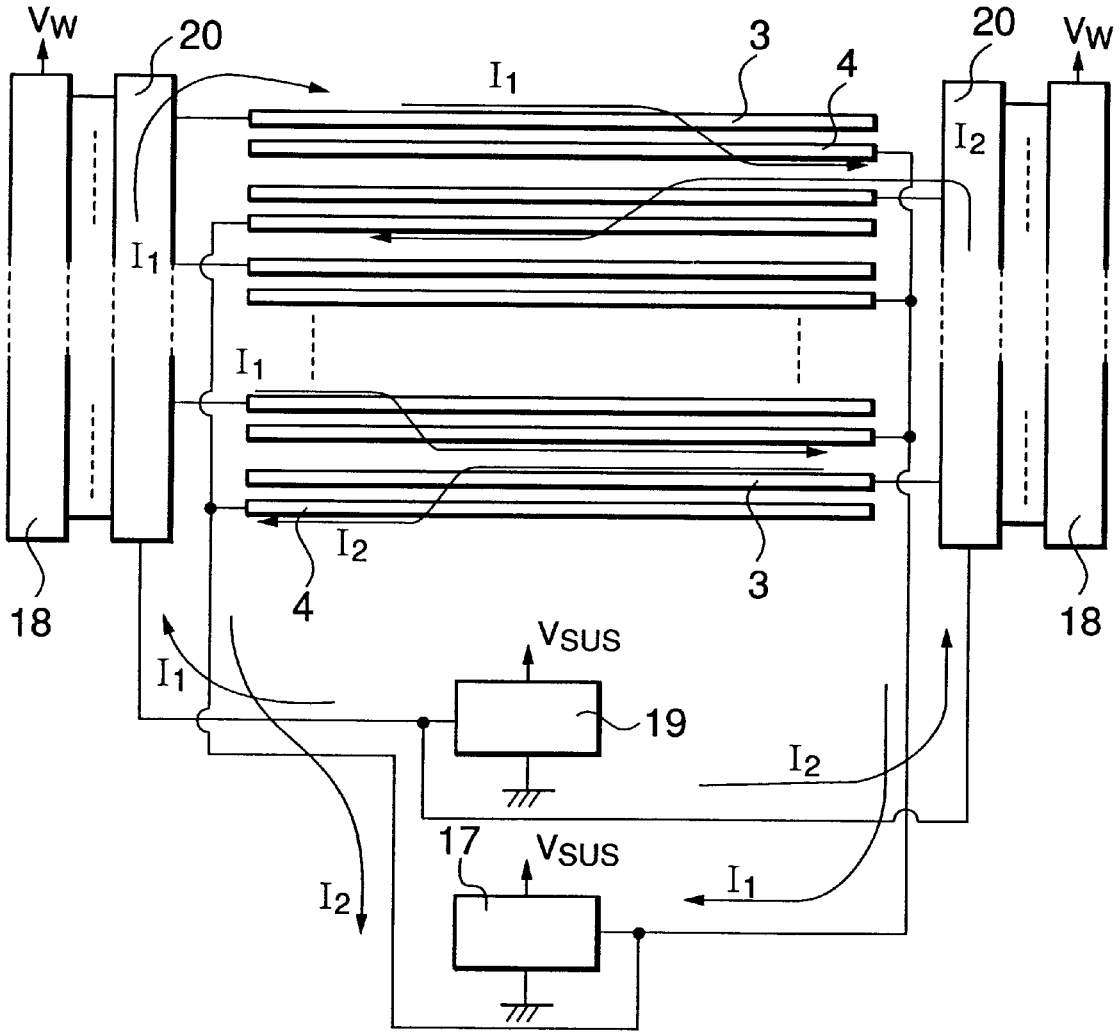
FIG. 1 is a schematic view showing paths of impulse currents during a sustaining discharge period of a plasma display device according to the first embodiment of the invention.

Referring to FIG. 1, a plurality of scanning electrodes 3 and a plurality of sustaining electrodes 4 are arranged alternatively on the same substrate (not shown) to form a plurality of surface discharge electrode pairs. The number of the surface discharge electrodes is the same number of desired display lines. In FIG. 1, for simplification, data electrodes are not shown and only five pairs of surface discharge electrodes are shown. These surface discharge electrode pairs are disposed in the order of the scanning electrodes 3 and the sustaining electrodes 4. In this embodiment, a lead of the scanning electrodes 3 of the first pair is taken out from the left side thereof, and connected to a high voltage pulse generator 19 through the first mixer 201, while a lead of the sustaining electrode 4 thereof is taken out from the right side and connected to a high voltage pulse generator 17. Subsequently, a lead of the scanning electrodes 3 of the second pair is taken out from the right side thereof and connected to the high voltage pulse generator 19 through the second mixer 202, while a lead of the sustaining electrode 4 thereof is taken out from the left side, and connected to the high voltage pulse generator 17. Such connections are successively repeated. Each of the first and second mixers 201 and 202 is a conventional well-known diode circuit for mixing the output of a high voltage pulse generator 19 for the scanning electrodes 3 and the output of a scanning driver 18.

During a write-in discharge period, as conventionally, the scanning pulses are successively applied to the scanning electrodes 3, and data pulses synchronized with these scanning pulses are applied to data electrodes so as to address desired display data. For this reason, the scanning electrodes 3 are driven separately by a pair of scanning driver 18, while all of the sustaining electrodes 4 are connected commonly to the pulse generator 17. During a sustaining period, high voltage pulses of opposite phase are applied to the scanning electrodes 3 and sustaining electrodes 4, respectively, so that the sustaining electrodes 4 sustain discharges following the data addressed in the write-in discharge period, thereby maintaining a display discharge.

As described above, the lead-outs of the surface discharge electrodes, formed with the scan electrodes 3 and the maintenance electrodes 4 are alternate with respect to the left and right with the adjacent surface discharge electrode pairs. Thereby, the impulse current flowing paths during the sustaining discharge period can be generated concurrently in the alternate left and right directions with respect to the adjacent surface discharge electrode pairs. The impulse current paths during the sustaining discharge period are shown with "I1" and "I2" in FIG. 1 and FIG. 2. The impulse currents are generated along the current paths I1 and I2 by the current flowing into the high voltage pulse generator 17 for the sustaining electrodes 4 from the high voltage pulse generator 19 for the scanning electrodes 3, when the sustaining pulses for the scanning electrodes 3 rises while pulse voltage pulse for the sustaining electrodes 4 falls. Accordingly, during the sustaining discharge period, in the path of the high voltage pulse generator 19, the mixers 201 and 202, the scanning electrodes 3, the sustaining electrodes 4 and the high pulse generator 17, the impulse current pah I1 and the opposite path I2 are generated concurrently and alternately.

As a result, it is possible to counterbalance each other radiation of the electromagnetic field caused from the impulse currents of the adjacent current paths I1 and I2, so that the strength of the unnecessary radiation of the electromagnetic field is largely suppressed.

Since the wiring of both of the high voltage pulse generators 17 and 19 are arranged in parallel by approaching as closed as possible, the radiation of the electromagnetic field generated by the drive circuit and the wiring from the drive circuit to the plasma display panel are largely offset each other. This will be explained more in detail referring to FIG. 2.

Figure 2:
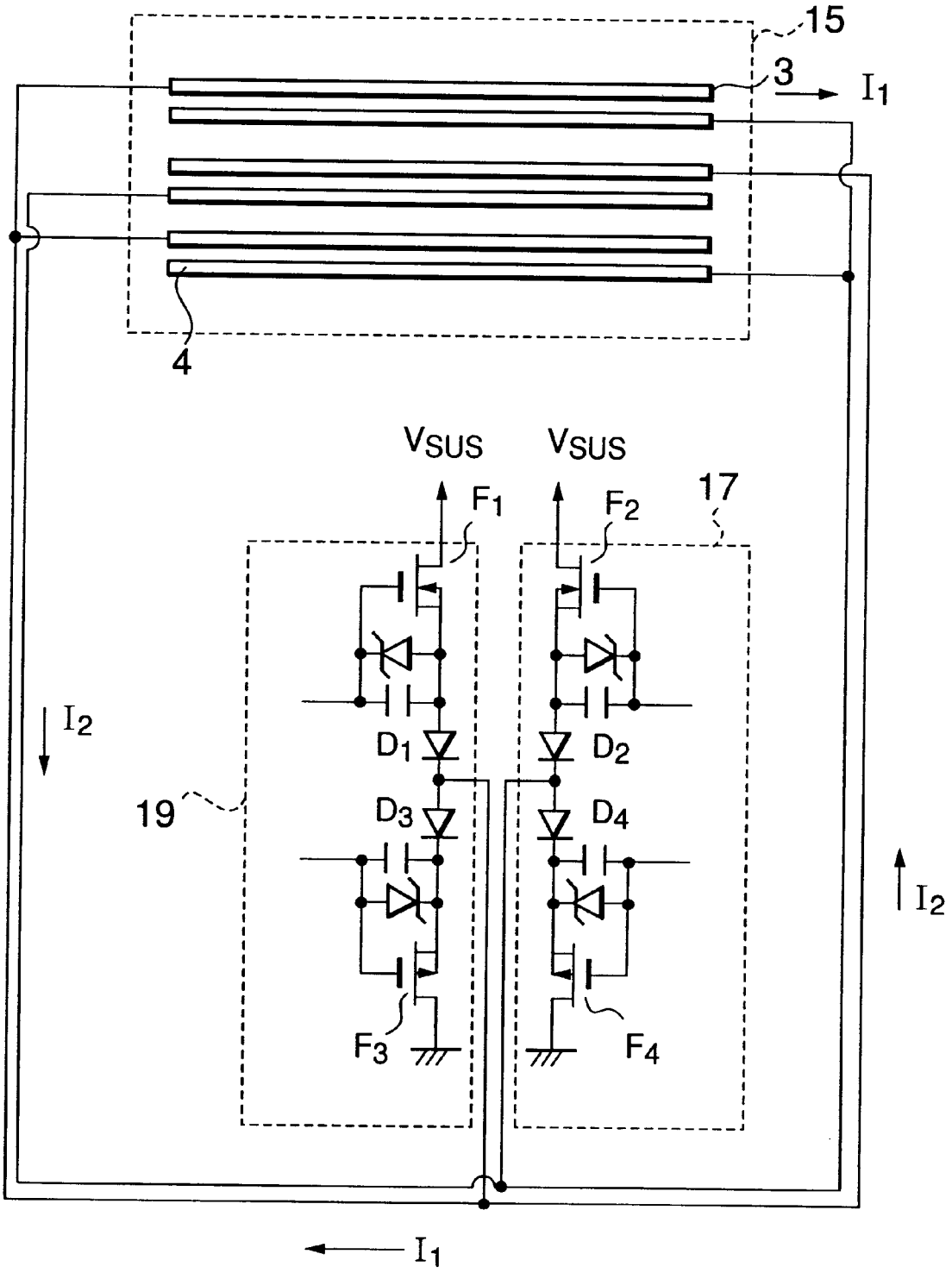
FIG. 2 is a schematic view showing an arrangement of electrodes and wiring of driving circuits of a plasma display device according to the first embodiment.

FIG. 2 shows a high voltage circuit of a high voltage pulse generator 17 for the sustaining electrodes 4 and the high voltage pulse generator 19 for the scanning electrodes 3. This is such a circuit switching between the sustaining voltage VSUS and the ground (GND) to generate the rectangular wave voltage pulses of VSUS and OV. During the sustaining discharge period, rectangular wave pulses of opposite phase are generated from the high voltage pulse generators 17 and 19 so as to drive the scanning electrodes 3 and the sustaining electrodes 4, respectively. Accordingly, it is repeated that when the voltage applied to the sustaining electrodes 4 is VSUS, the voltage applied to the scanning electrodes 3 is OV, and when the voltage applied to the sustaining electrodes 4 is OV, the voltage applied to the scanning electrode is VSUS. This performance is repeated, so that the discharge is generated between the pair of the surface discharge electrodes to maintain the display. Therefore FETs F1, F2, F3 and F4 shown in FIG. 2 repeats that when F1 and F4 are ON, F2 and F3 are OFF, while when F1 and F4 are OFF, F2 and F3 are ON, and the impulse currents flow in F1 and F4 as well as F2 and F3 concurrently. Taking such performance into consideration, this embodiment arranges directions of currents flowing in F1 and F4 to be opposite in the vicinity of F1 and F4 as well as F2 and F3 to be switched at the same time. F2 and F3 are arranged similarly. Further, parts of the high voltage circuits such as diodes D1, D2, D3 and D4 are arranged by paying the same attention as disclosed above. Also, the wiring of the circuit pattern connecting parts of the circuits generating high voltage are arranged such that the impulse currents flowing therein are opposite between the adjacent wires.

According to this embodiment, since the impulse currents generated during the sustaining discharge period flow in the opposite direction with respect to the adjacent electrodes, circuit parts and wiring, the radiation of the electromagnetic field generated from the impulse currents are offset each other, and unnecessary radiation of the electromagnetic field is largely suppressed.

Figure 3:
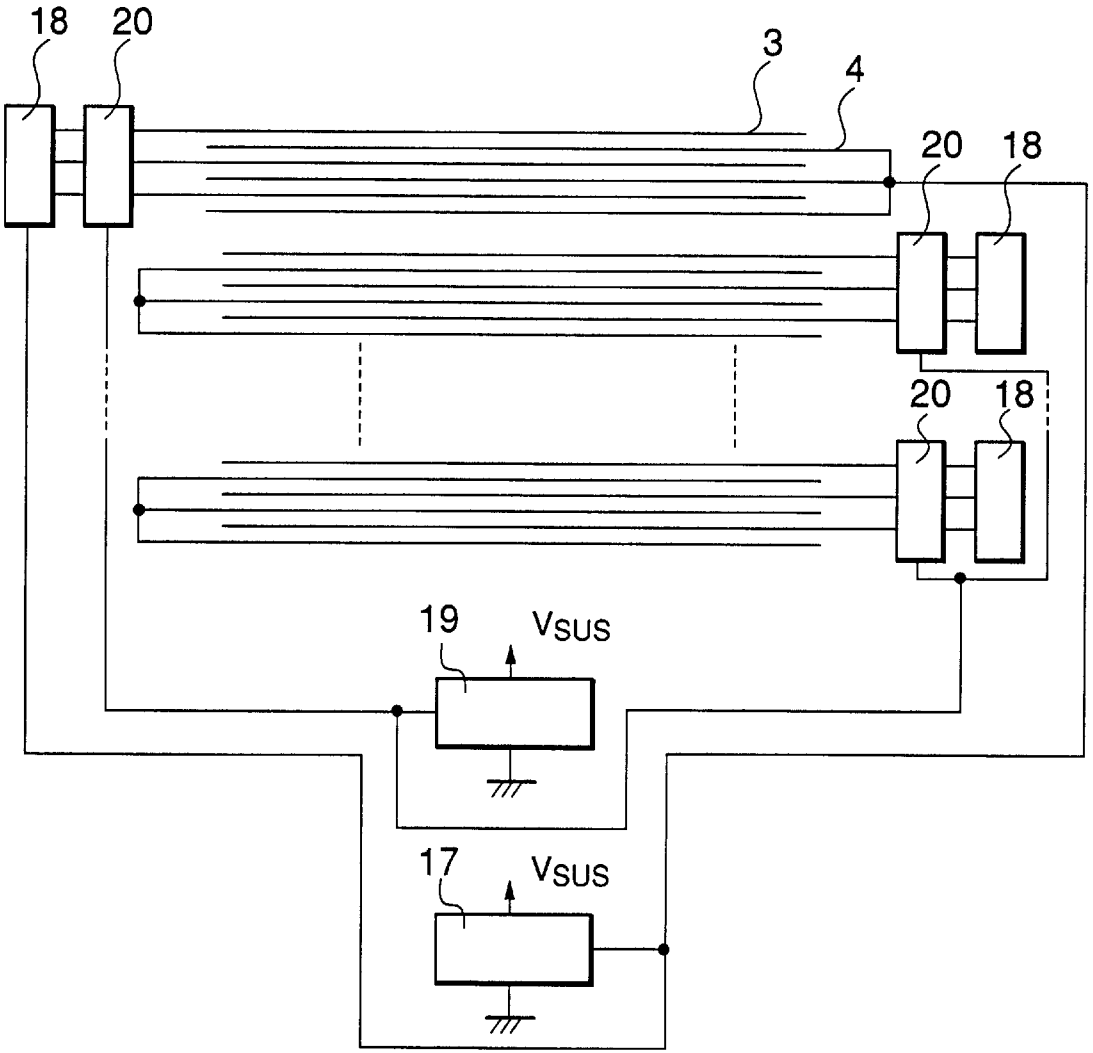
FIG. 3 is a schematic view showing an arrangement of electrodes and wiring of drive circuits of a plasma display device according to the second embodiment of the invention.
Figure 4:
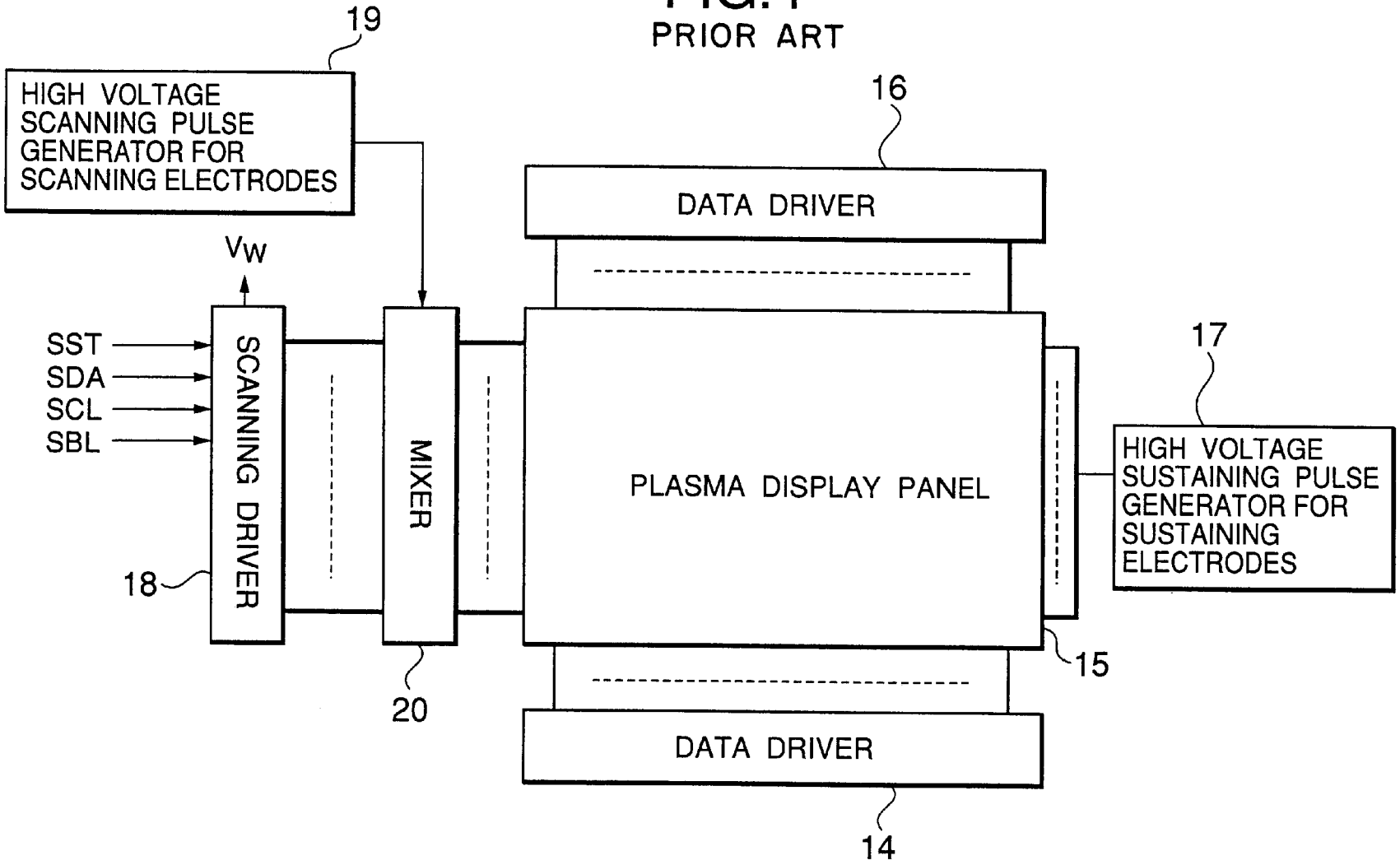
FIG.4 PRIOR ART
FIG. 4 is a block diagram showing a system configuration of a conventional surface discharge type plasma display device.
Figure 5:
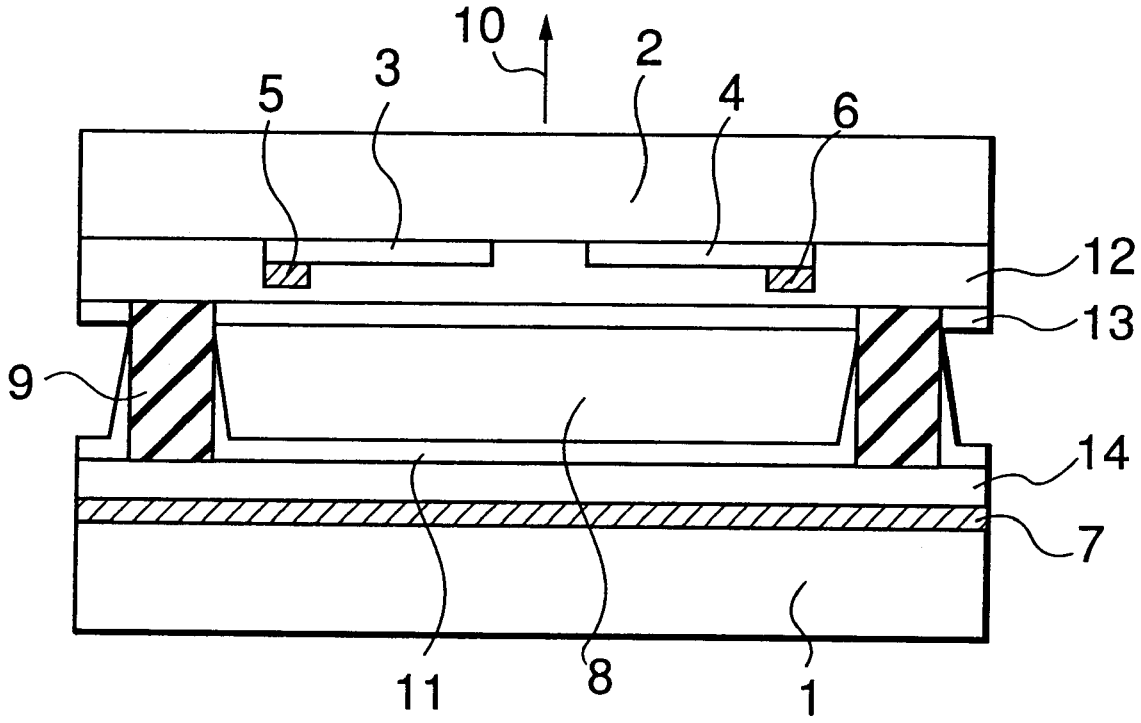
FIG.5 PRIOR ART
FIG. 5 is a schematic cross sectional view of one example showing a surface discharge type plasma display panel.
Figure 6:
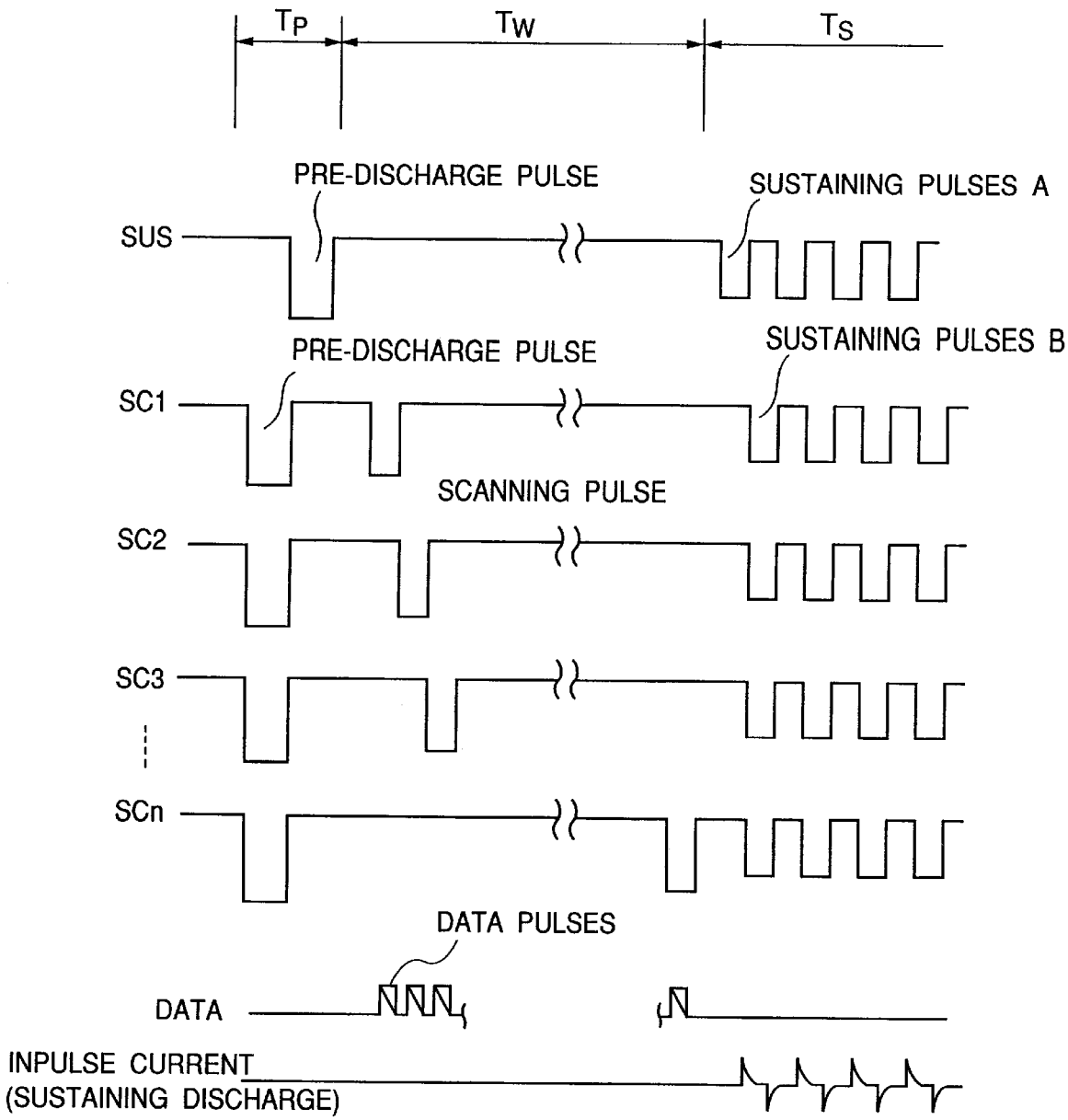
FIG.6 PRIOR ART
FIG. 6 is a schematic view showing the driving pulses of a surface discharge type plasma display.
Figure 7:
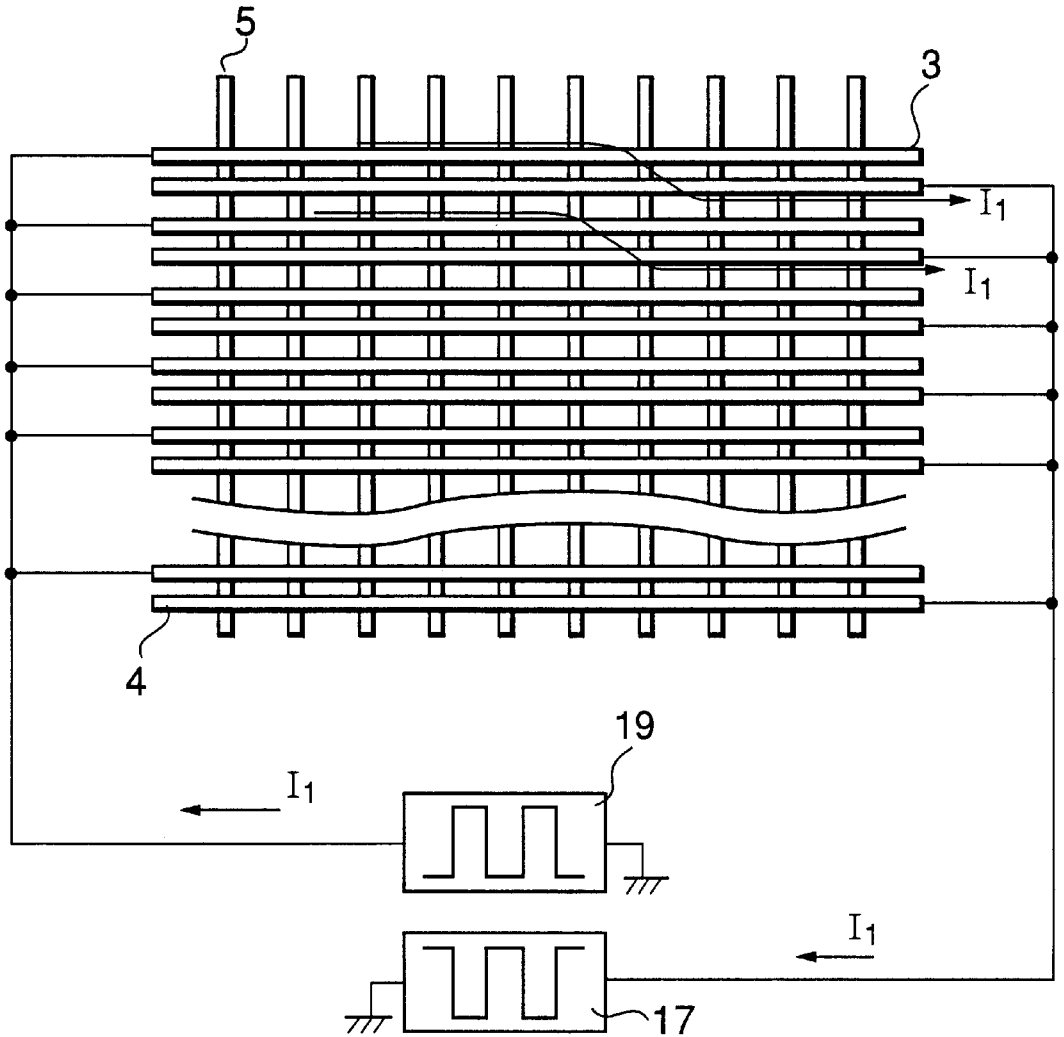
FIG.7 (PRIOR ART)
FIG. 7 is a schematic view showing paths of impulse currents during a sustaining discharge period of a conventional plasma display device.

A second embodiment of this invention will be explained referring to FIG. 3. In FIG. 3, the plasma display is divided into a plurality of blocks to apply the first embodiment herein. The division of the block has advantage that if the number of output terminals of IC is block-divided as minimum units when composing a scanning driver 18 with IC, the scanning pulses during the write-in discharge period may be easily controlled. However, according to this method, since the distance of the impulse current flowing in the opposite is made larger than the first embodiment, the strength of the radiation of the electromagnetic field to be offset is made small, so that the unnecessary radiation has smaller effect than the first embodiment. However, comparing it with a large faceplate display, display cell pitches are fine for realizing display devices of high precision, and therefore the strength of the unnecessary radiation of the electro-magnetic field can be easily suppressed, and this embodiment is suited because signals are easily processed. Also in this example, the wiring of the high voltage pulse generator 19 for the scanning electrodes 3 and the high voltage pulse generator 17 for the sustaining electrodes 4 are formed in parallel by approaching as nearly as possible so that the radiation of electromagnetic field generated from the drive circuit sand the plasma display panel from the drive circuits are counterbalanced each other to largely reduce the unnecessary radiation of the electromagnetic field.

As explained above, in the embodiments that the leading-outs from the scanning electrodes 3 and the sustaining electrodes 4 are made alternate with respect to the adjacent surface electrode pairs; leads for the electrodes are led out alternately per determined number; and further the leading-outs are made in blocks alternately or combinations thereof are made;t there are differences in the suppressing effects of the unnecessary radiation of the electromagnetic field, however apparently the suppressing effects can be recognized in comparison with the conventional method.

As is seen from the above, the plasma display device of the present invention may counterbalance the radiation of the electromagnetic field from the impulse currents, and suppress the occurrence itself of the unnecessary radiation of the electromagnetic field by composing the panel electrode arrangement passing the impulse currents generated during the sustaining discharge period in the opposite directions, the drive circuits and the wiring of the drive circuits. As a result, although the prior art realized unnecessary radiation of electromagnetic field to be around 40 dB using an electromagnetic radiation filter or a special frames, the present invention can suppress unnecessary radiation of electromagnetic field to be not higher than 40 dB without paying attentions to the radiation filter of electromagnetic field or a special frame. Thus, it is possible to reduce addition of the above-mentioned electromagnetic shielding filter necessary in the conventional plasma display for suppressing the unnecessary radiation of the electromagnetic field and largely lower costs for strengthening the shielding function of the frames.

What is claimed is:

1. A surface discharge type plasma display device comprising:

a first group of a plurality of surface discharge electrode pairs extending in a first direction; and a second group of a plurality of surface discharge electrode pairs extending in the first direction, each of the surface discharge electrode pairs of the first and second groups having a scanning electrode and a sustaining electrode forming said pair, said first group of a plurality of surface discharge electrode pairs being applied with first sustaining pulses to provide a first surface discharge between said scanning electrode and said sustaining electrode, said first surface discharge generating a first impulse current, said second group of a plurality of surface discharge electrode pairs being applied with second sustaining pulses to provide a second surface discharge between said scanning electrode and said sustaining electrode, said second surface discharge generating a second impulse current, and said first impulse current and said second impulse current flowing concurrently in opposite directions.

2. A surface discharge type plasma display device according to claim 1, wherein a surface discharge direction of an adjacent pair of said surface discharge electrode pairs is opposite to each other within said first and second group of a plurality of surface discharge electrode pairs.

3. A surface discharge type plasma display device according to claim 2, wherein said first sustaining pulses are generated by a first high voltage pulse generator connected commonly to said sustaining electrode, and said second sustaining pulses are generated by a second high voltage pulse generator connected commonly to said scanning electrodes.

4. A surface discharge type plasma display device according to claim 1, wherein said first sustaining pulses are generated by a first high voltage pulse generator connected commonly to said sustaining electrode, and said second sustaining pulses are generated by a second high voltage pulse generator connected commonly to said scanning electrodes.

5. A surface discharge type plasma display device according to claim 1, wherein each of said first group and said second group is divided into a plurality of blocks so as to be driven by a plurality of scanning drivers with a relationship of one block to one scanning driver.

6. A surface discharge type plasma display device according to claim 1, wherein said first group and said second group are formed on a first substrate, and a plurality of data electrodes are formed on a second substrate opposing to said first substrate to form a plurality of display pixels.

7. A surface discharge type plasma display device comprising:

a first group of a plurality of surface discharge electrode pairs; and a second group of a plurality of surface discharge electrode pairs, each of the surface discharge electrode pairs of the first and second groups having a scanning electrode and a sustaining electrode forming said pair, said first group of a plurality of surface discharge electrode pairs being applied with first sustaining pulses to provide a first surface discharge between said scanning electrode and said sustaining electrode, said second group of a plurality of surface discharge electrode pairs being applied with second sustaining pulses to provide a second surface discharge between said scanning electrode and said sustaining electrode, said first surface discharge and said second surface discharge having a discharge current flowing in an opposite direction, wherein said first sustaining pulses are generated by a first high voltage pulse generator connected commonly to said sustaining electrodes, and said second sustaining pulses are generated by a second high voltage pulse generator connected commonly to said scanning electrodes, and said first high voltage pulse generator is connected to said sustaining electrodes through a pair of first wires such that one of said first wires is commonly connected to one end of every other one of said sustaining electrodes and the other one of said first wires is commonly connected to an opposite end of remaining ones of said sustaining electrodes, and said second high voltage pulse generator is connected to said scanning electrodes through a pair of second wires such that one of said second wires is commonly connected to one end of every other one of said scanning electrodes via a first mixer circuit and the other one of said second wires is commonly connected to an opposite end of remaining ones of said scanning electrodes.

8. A surface discharge type plasma display device according to claim 7, wherein said one of said first wires and said one of said second wires are closely arranged so as to have a portion extending in a parallel relationship to off set said radiation of electromagnetic field thereat during a sustaining discharge period, and said other one of said first wires and said other one of said second wires are closely arranged so as to have a portion extending in a parallel relationship to off set said radiation of electromagnetic field thereat during said sustaining discharge period.

9. A surface discharge type plasma display device according to claim 7, wherein said first mixer circuit is connected to a first scanning driver and said second mixer circuit is connected to a second scanning driver.

* * * * *